US005269245A

United States Patent [19]

Bystedt et al.

[11] Patent Number: 5,269,245

[45] Date of Patent: Dec. 14, 1993

[54] HULL STRUCTURE FOR MULTI-HULL SHIPS

[75] Inventors: Stig Bystedt, Uddevalla; Orvar Toreskog, Alingsås, both of Sweden

[73] Assignee: Stena Rederi Aktiebolag, Gothenburg, Sweden

[21] Appl. No.: 828,142

[22] Filed: Jan. 30, 1992

[30] Foreign Application Priority Data

Jan. 30, 1991 [SE] Sweden ..... 9100288

[51] Int. Cl.[5] ..... B63B 1/04; B63B 1/10

[52] U.S. Cl. ..... 114/61; 114/56

[58] Field of Search ..... 114/61, 56, 256

[56] References Cited

U.S. PATENT DOCUMENTS

| | | | |
|---|---|---|---|
| 3,447,502 | 6/1969 | Leopold | 114/61 |
| 4,552,083 | 11/1985 | Schmidt | 114/61 |
| 4,798,153 | 1/1989 | Schmidt | 114/61 |
| 4,811,676 | 3/1989 | Franke | 114/56 |

FOREIGN PATENT DOCUMENTS

| | | | |
|---|---|---|---|
| 108004 | 5/1984 | European Pat. Off. . | |
| 1456226 | 11/1969 | Fed. Rep. of Germany | 114/56 |
| 2505286 | 11/1982 | France . | |
| 99486 | 4/1990 | Japan | 114/56 |
| 455466 | 10/1936 | United Kingdom | 114/56 |
| 1136861 | 12/1968 | United Kingdom . | |

*Primary Examiner*—Sherman D. Basinger

*Attorney, Agent, or Firm*—Keck, Mahin & Cate

[57] ABSTRACT

A hull intended for multi-hull vessels for goods and passenger transport at speeds of, e.g., 30–50 knots is characterized in that the vertical distance from the base line of the hull to the center-of-gravity point of the volume of the underwater body of the hull, up to a water line corresponding to a normal hull draft, is over 55% of the hull draft defined between the base line (BL) and the water line (T) in the case of the stern half of the hull extending between the stern and midships. The hull is also characterized in that the vertical position of the center-of-gravity point of the volume of the forward half of the hull, located beneath the water line and extending between the midships and the forward part of the hull, is less than 55% of the draft, and in that the distance between the base line (BL) and the center-of-gravity point of the frame area beneath the water line (T) at a position corresponding to 75% of the total length of the underwater body of the hull, calculated from the stern, is less than 55% of the draft.

9 Claims, 1 Drawing Sheet

HULL STRUCTURE FOR MULTI-HULL SHIPS

BACKGROUND OF THE INVENTION

The present invention relates to a hull structure for a multi-hull ship.

Although conventional multi-hull ships of the catamaran type have several well-known intrinsic advantages, one troublesome drawback, however, is that when in motion vessels of this kind move vertically in a manner which is experienced as being unpleasant to passengers and which generates unfavourable vertically-acting acceleration forces on goods transported by such vessels. Consequently, development of multi-hull vessels has resulted in a hull which has a narrow cross-section at the water line, so that a small lifting force is generated by waves that act on the hull. At the same time, those parts of the hull which are located beneath the surface of the water are joined to those parts of the hull which are located above said surface by means of narrow connections. This results in problems with respect to the equipment required to propel the vessel and also results in a greater need for power. Water-jet propulsion is favourable in the case of high-speed vessels, for instance vessels which are built for speeds of up to 40 knots, although water-jet propulsion units are, of course, only suitable for installation at the water line of the vessel concerned. Catamaran type vessels which have a narrow hull waist at the water line (SWATH=-Small Water Area Twin Hull) are therefore, in practice, powered by a propeller drive. A screw propeller, however, places a limitation on the speed at which the vessel can be propelled through the water, since the propeller will erode or cavitate when subjected to high loads. Furthermore, the propeller needs to be driven by a complex and expensive transmission from a drive motor mounted in a hull superstructure. Alternatively, the engine can be mounted in part of the hull that lies beneath the water line, although this would present problems with regard to fitting and maintaining the engine, and also with regard to the supply of air, the discharge of exhaust gases and like features, particularly when the vessel concerned is intended for speeds in the order of 40 knots, in which case gas turbines constitute a realistic alternative. SWATH-vessels have, of course, a low load stability, since the part of the hull which extends above the water line has a relatively small cross-sectional area. Consequently, it is necessary to adjust the buoyancy or floating state of SWATH-type vessels during movement of the vessel through the water with the aid of separate means, such as fins, ballast tanks or the like, which naturally represent complications and a cost increase. The buoyancy or floating stability of the hull will also, of course, present a problem when loading and unloading the vessel.

SUMMARY OF THE INVENTION

An object of the present invention is to provide a hull of favourable construction for multi-hull vessels. Thus, the objective of the invention is to provide a hull structure which a) has low tendency to upward lift under the influence of waves during movement of the vessel through the water, b) is highly efficient and will allow the vessel to be propelled at high speeds, c) will result in only a small reduction in speed in high seas, d) has a high load resistance and will enable the vessel to be powered by means of any desired power means, including water-jet propulsion systems, and e) has a high stern stability so as to enable the vessel to be loaded and unloaded from the stern thereof.

The invention can be applied advantageously to fast passenger and cargo-carrying catamarans, for instance vessels which have a speed of 30–50 knots, a length of 120 meters, a width of, e.g., 40 meters, and a submerged volume of up to 3000 $m^3$ The invention is defined in the following claim 1.

Further developments of the invention are set forth in the depending claims.

The inventive hull construction can be described as comprising a forward hull part which has an onion-shaped underwater cross-section, i.e. a waisted part in the region of the water line and a rearward hull part which merges continuously therewith and the local draft of which decreases in a direction towards the stern while simultaneously the width of the hull at the water line increases in this direction. This imparts to the stern of the vessel a shape which is favourable for water-jet propulsion. The invention is not restricted to water-jet propulsion, however. As a result of the invention, the hull has a relatively large width at the water line at the stern part of the hull, which enables propulsion engines and like prime movers to be readily fitted to the hull with the absence of any problems concerning air intake, exhaust gas discharge, lifting and lowering of engines, etc. Because the hull has a relatively large water line width in relation to the maximum width of the hull beneath the water line, particularly at the stern of the hull, the hull has good stability, particularly at its stern part, therewith favouring the loading and offloading of cargo from the stern of the vessel.

The onion shape of the forward part of the hull cross-section, i.e. a relatively narrow hull waist in the vertical region of the hull that extends up through the water line, as a continuation of a more generally U-shape of the hull stern, limits the wave-dependent vertical movement associated with conventional catamaran hull designs that include a generally uniform hull cross-section along the length of the hull. As a result of the onion-like shape of the cross-section of the forward hull part, the wave-exerted lifting force will be lower at the forward part of the hull, and motion-restricting suction forces will occur at the bottom surface of the hull structure and at the upwardly facing wet surfaces of the hull as the hull moves vertically in the water.

A hull structure intended for multi-hull vessels conventionally has a generally constant cross-sectional shape along the length of the hull, wherein a conventional cross-sectional design of a catamaran hull includes a generally V-shaped bottom from which generally vertical sides extend. The invention differs from this conventional hull design in essential respects. Firstly, the width of the inventive hull decreases generally in a forward direction at the water line, while maintaining a substantially constant frame area beneath the water line, along the length of the hull, although this area will, of course, decrease at the forward and aft parts of the hull.

Consequently, the hull will have a relatively large width at the water line in the stern parts of the hull, therewith enabling the local draft of the hull at the stern part thereof to be restricted.

The invention affords the following advantages:

The vessel propulsion equipment, including engines, can be mounted comfortably in the hull and easily maintained, without requiring the use of complicated and power-requiring transmissions.

The hull is able to withstand loads, particularly the stern of the hull.

The hull is adapted for high speeds, for instance speeds of 40 knots.

The hull can be equipped with water-jet propulsion means if so desired, and the hull has a relatively low pitching tendency during movement of the vessel through the water, thereby rendering the hull suitable for vessels which are intended to transport both passengers and goods.

An object of the invention is, among other things, to restrict accelerated movement of multi-hull vessels to an extent which will obviate the need of lashing down vehicles, such as lorries and trucks, transported by the vessel concerned, under normal sea conditions. Tests have shown that the illustrated and described hull embodiment can be propelled through the water without problems at a significant wave height of about 4 meters.

It has been mentioned above that the hull structure enables the use of water-jet propulsion devices and will enable speeds of about 40 knots to be achieved in twin-hull vessels for carrying vehicles and passengers at a total dead weight (load capacity) of 1,000–2,000 tonnes and with a length of, e.g., 120 meters and a width of, e.g. 40 meters, although it will be understood that these values are merely intended to illustrate the technical effect provided by the hull structure and do not restrict the scope of the invention.

It will also be understood that the inventive hull structure can be used, while retaining the advantages afforded thereby, with multi-hull vessels of different sizes, with different numbers of hulls, intended for lower and higher speeds, and for other methods of vessel propulsion.

BRIEF DESCRIPTION OF THE DRAWINGS

The invention will now be described in more detail with reference to a preferred embodiment of an inventive hull structure and with reference to the accompanying drawings.

DESCRIPTION OF THE PREFERRED EMBODIMENT

Figure 1:
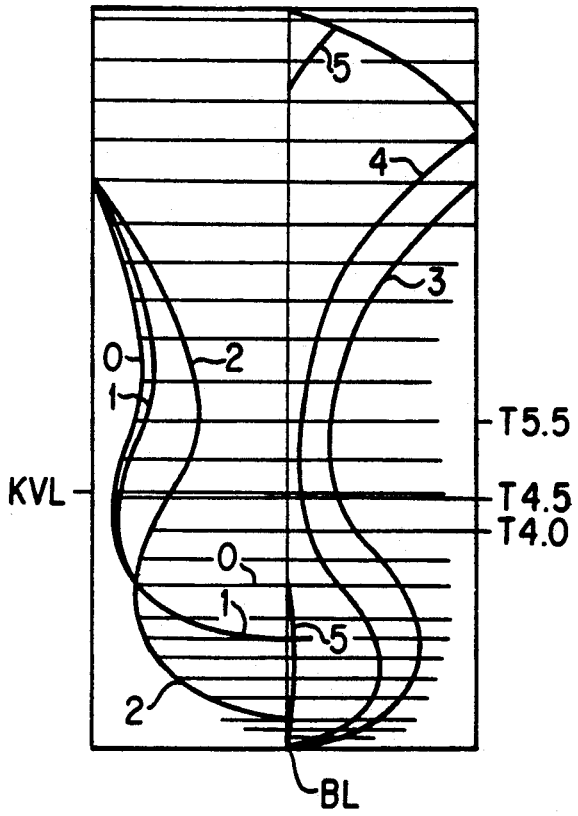
FIG. 1 illustrates a body plan for a forward and sternward half of an inventive hull.

FIG. 1 illustrates a body plan for an inventive hull structure, which is illustrated by six similar, separate frames numbered from 0 to 5, beginning from the stern frame 0 to the forward frame 5.

FIG. 1 also illustrates the position of the hull KVL (construction water line corresponding to a normal draft T). Also shown is the hull base line BL, which is a reference line that extends horizontally and includes the lowest point of the hull.

Figure 2:
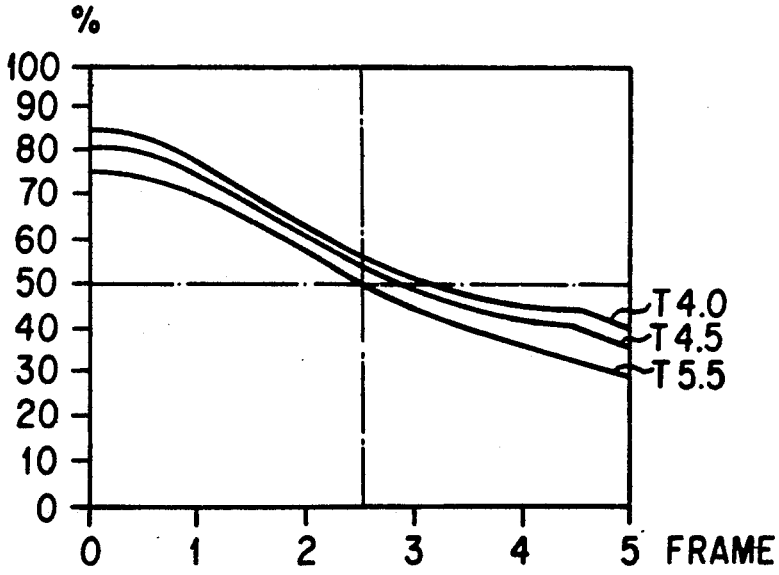
FIG. 2 is a graph which illustrates the position of the centre of gravity of the hull frame area of the hull along the length of the hull.

The ordinate axis of the graph shown in FIG. 2 relates to the vertical centre point of the body plan up to T over BL in percent of the draft T, while the abscissa axis relates to the positions of the frames 0–5. The curves shown in FIG. 2 relate to a number of mutually different drafts, indicated in FIG. 1.

The curves shown in FIG. 2 are characteristic of the invention and, in accordance with the invention, the distance from the hull base line BL to the volumetric centre-of-gravity, or point of gravity, of the wet frame area of the frame, i.e., the frame area delimited by the water line, at the position which corresponds to 75% of the length of the underwater body beginning from the stern, is less than 55% of the draft and, preferably, attains to at most 50% of the draft to BL. Further, the centre-of-gravity distance from BL for the rearmost stern frame which reaches up to the water line shall be greater than 65% of the draft, whereas the centre-of-gravity distance from BL for the frame located furthest forward and reaching up to the same water line shall be less than 50% of the draft.

In the case of the stern half of the underwater hull, the distance between the volumetric centre of gravity and BL shall exceed 55% of the draft and preferably exceed 60% of the draft. In the case of the forward half of the underwater hull, a vertical distance from the hull base line BL to a volumetric centre-of-gravity is less than 55%, and preferably less than 50%, of the draft of the forward half of the underwater hull.

It will be seen from FIG. 2 that the distance between the centre of gravity of the frame area beneath the water line and BL changes relatively continuously in the foreward direction, i.e., from the stern to the forebody, of the vessel, which has a general applicability, although one skilled in this art will realize that the shape of the hull can be varied in a manner which although deviating visibly in the graph will in practice not involve any essential departure from the inventive concept.

Figure 3:
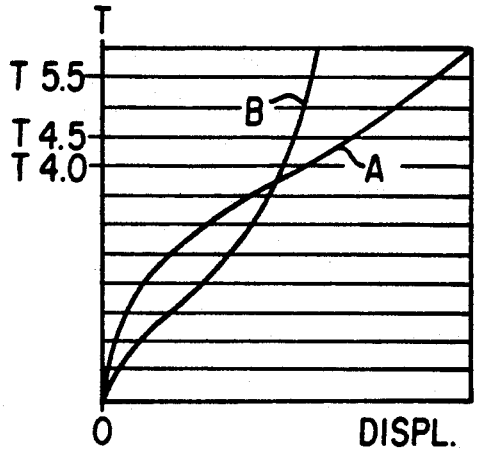
FIG. 3 is a graph showing the displacement of the forward and sternward parts of the hull at different drafts.

The ordinate axis in the graph shown in FIG. 3 relates to the draft T of the hull illustrated in FIG. 1, while the abscissa relates to the displacement of the hull. The curves A and B in FIG. 3 relate respectively to the stern and the forebody of the hull illustrated in FIG. 1.

It will be seen from FIG. 3 that the waves exert a relatively low lifting force on the forebody due to a relatively small increase in displacement at increasing drafts. Correspondingly, it can be seen from FIG. 3 that the hull afterbody is highly tolerant to load, i.e. the increase in draft due to load is relatively small. The afterbody of the hull is less sensitive or responsive than the forebody with respect to vertical movement caused by waves bearing on the hull. The general experience gained with conventional seagoing vessels is that hull pitching movements occur around a pivot point which is located at a point about ⅓ of the hull length from the stern. The pivot point for pitching movements of the inventive hull, on the other hand, lies approximately at ¼ or 1/5 of the hull length from the forward part of the hull.

Referring again to FIG. 1, it will be seen that the local draft of the hull decreases in the afterbody of the hull in a sternward direction. In the case of the illustrated embodiment, the local draft at the stern of the hull falls to about 50% of the hull draft. The hull has its maximum local draft in the area forward of its length centre. It will also be seen that the width of the hull at the water line is substantially constant in a sternward quarter part of the vessel and then decreases generally continuously towards the forebody of the hull.

It will also be noted that the width of the underwater body of the hull increases downwards from the water line, at least from fore to midships, whereby the underwater hull-body has an onion-shaped, cross-section in this length region.

It will seen from FIG. 1 that changes in draft from the normal draft only slightly alter the area and shape of the hull at the water surface and that the width of the hull decreases in the area above the water line such that the additional lifting force exerted against the hull by the waves is relatively restricted (as is general in the case of SWATH-hulls), wherewith the additional lifting force is smaller at the forward parts of the inventive hull due to the smaller width of the hull in those forward hull parts which lie above the water line.

Because the inventive hull has a pronounced onion shape solely at the forward part of its underwater body, the upwardly facing surfaces of the displacement body are relatively large in the foreward parts of the underwater body, whereby the downward movement of the hull during pitching motion is greatly restricted in the forward part of the hull. The exemplifying hull structure described above relates to a hull for a twin-hull vessel which is intended to be propelled at a speed of about 40 knots, said hull having a draft of about 4.5 m, an underwater part having a width of about 5 m, and a length of about 120 m.

The exemplifying embodiment of the hull structure is typical of the invention and one of normal skill in this art should have no difficulty in practicing the invention on hulls of other sizes and under other conditions.

The base line BL is parallel with the hull water line and extends through the lowermost point of the actual hull itself, i.e. excluding keels. The draft is therewith the distance between the base line and the water line. By local draft is meant the lowermost point of the actual hull itself at a given point along the length of the hull.

We claim:

1. A hull for multi-hull seagoing vessels comprising:

a forward half located between a forebody of the hull and a midship location; and a sternward half located between a stern of the hull and said midship location;

wherein a vertical distance from a hull base line to a volumetric centre-of-gravity of an underwater body portion of the hull up to a water line corresponding to a normally occurring hull draft is greater than 55% of a draft, defined between the hull base line and the water line, of the sternward half, said vertical distance is less than 55% of a draft of the forward half, the distance from the hull base line and the volumetric centre-of-gravity of a frame area delimited by the water line at a position corresponding to 75% of a total length of the underwater body portion of the hull, calculated from the stern of the hull, is less than 55% of the draft, and the hull has a width at the water line which is substantially greater in the sternward half than in the forward half.

2. A hull according to claim 1, characterized in that the vertical distance from the hull base line to the volumetric centre-of-gravity of a frame area beneath the water line at the position corresponding to 75% of the total length of the underwater body portion of the hull, calculated from the stern of the hull, is less than 50% of the draft.

3. A hull according to claim 2, characterized in that the vertical distance between the hull base line and the volumetric centre-of-gravity of the frame area beneath the water line falls essentially continuously from the stern to the forebody of the hull.

4. A hull according to claim 1, characterized in that the vertical distance from the hull base line to the centre of gravity is at least 60% of the draft of the sternward half of the hull and less than 50% of the draft of the forward half of said hull.

5. A hull according to claim 1, characterized in that the vertical distance from the hull base line to a volumetric centre-of-gravity of a frame area, up to the water line, for a sternmost frame which reaches up to the water line is greater than 65% of the draft; and in that the vertical distance from the hull base line to the volumetric centre-of-gravity of a foremost frame, which reaches up to the water line, is less than 50% of the draft.

6. A hull according to claim 1, characterized in that the draft of said hull decreases, in the sternward half, in a sternward direction.

7. A hull according to claim 6, characterized in that the draft at the stern of the hull falls to about 50% of a maximum draft.

8. A hull according to claim 1, characterized in that the width of the hull at the water line is substantially constant in a sternward quarter part of the vessel and then narrows towards the forebody.

9. A hull according to claim 1, characterized in that a cross-sectional shape at the forward half of the hull includes a bulbous underwater part and a narrow waisted part which extends through the water line.

* * * * *